US006773333B2

(12) United States Patent
Lundt et al.

(10) Patent No.: US 6,773,333 B2
(45) Date of Patent: Aug. 10, 2004

(54) METHOD FOR CUTTING SLICES FROM A WORKPIECE

(75) Inventors: Holger Lundt, Burghausen (DE); Lothar Huber, Burghausen (DE); Peter Wiesner, Reut (DE)

(73) Assignee: Siltronic AG, Munich (DE)

( * ) Notice: Subject to any disclaimer, the term of this patent is extended or adjusted under 35 U.S.C. 154(b) by 27 days.

(21) Appl. No.: 10/139,210

(22) Filed: May 3, 2002

(65) Prior Publication Data

US 2002/0174861 A1 Nov. 28, 2002

(30) Foreign Application Priority Data

May 10, 2001 (DE) ..... 101 22 628

(51) Int. Cl.[7] ..... B24B 49/00
(52) U.S. Cl. ..... 451/7; 125/16.02
(58) Field of Search ..... 451/53, 41, 21, 451/7, 164, 488, 449, 8; 125/16.02, 16.01, 35, 21

(56) References Cited

U.S. PATENT DOCUMENTS

| | | | | |
|---|---|---|---|---|
| 4,655,191 A | | 4/1987 | Wells et al. | |
| 5,269,285 A | * | 12/1993 | Toyama et al. | 125/16.01 |
| 5,771,876 A | * | 6/1998 | Egglhuber | 125/21 |
| 5,827,113 A | * | 10/1998 | Okuno et al. | 451/36 |
| 6,006,738 A | * | 12/1999 | Itoh et al. | 125/21 |

FOREIGN PATENT DOCUMENTS

| | | | |
|---|---|---|---|
| DE | 39 42 671 | 6/1991 | |
| DE | 199 59 414 | 6/2001 | |
| EP | 522 542 | 9/1995 | |
| EP | 1 097 782 | * 7/2000 | ..... B24B/27/06 |
| EP | 990498 | 11/2001 | |
| JP | 5-200734 | 8/1993 | |
| JP | 7-171753 | 7/1995 | |
| JP | 10-180750 | 7/1998 | |
| WO | 00/43162 | 7/2000 | |

OTHER PUBLICATIONS

English Derwent Abstract AN 1998–432340 corresponding to JP 10–180750.
English Derwent Abstract AN 1995–271878 corresponding to JP 7–171753.
English Derwent Abstract AN 1993–284992 corresponding to JP 5–200734.
English Derwent Abstract AN 200–565159 corresponding to WO 00/43162.
English Derwent Abstract AN 2002–141176 corresponding to DE 199 59 414.
English Derwent Abstract AN 1993–010396 corresponding to EP 522 542.
English Derwent Abstract AN 1991–186819 corresponding to DE 39 42 671.
English Derwent Abstract AN 2000–272301 corresponding to EP 990498.

* cited by examiner

*Primary Examiner*—Dung Van Nguyen
(74) *Attorney, Agent, or Firm*—Collard & Roe, P.C.

(57) ABSTRACT

A method for cutting up a workpiece which is in rod or block form by means of a saw, wherein the temperature of the workpiece is measured during the cutting, and the measurement signal is transmitted to a control unit, which generates a control signal which is used to control the temperature of the workpiece, or wherein the temperature of the workpiece is controlled during the cutting by a control signal based on a predetermined control curve.

8 Claims, 2 Drawing Sheets

METHOD FOR CUTTING SLICES FROM A WORKPIECE

BACKGROUND OF THE INVENTION

1. Field of the Invention

The invention relates to a method for cutting slices from a workpiece, in particular for cutting semiconductor wafers from semiconductor material which is in rod or block form.

2. The Prior Art

Semiconductor wafers are generally produced by cutting a monocrystalline or polycrystalline workpiece, which is in rod or block form and consists of the semiconductor material, into a multiplicity of semiconductor wafers simultaneously in one operation with the aid of a wire saw.

The main components of these wire saws include a machine frame, an advancing device and a sawing tool, which comprises a web of parallel wire sections. The wire web may, as described in the German patent application bearing the reference number 19959414.7-14, comprise a multiplicity of individual wires which are tensioned parallel to one another by a frame. Generally, however, the wire web is formed by a multiplicity of parallel wire sections which are tensioned between at least two wire-guiding rollers. The wire-guiding rollers are mounted rotatably and at least one of these rollers is driven. The wire sections may belong to a single, finite wire which is guided helically around the system of rollers and unwound from a stock reel onto a receiving roller.

On the other hand, the U.S. Pat. No. 4,655,191 discloses a wire saw in which a multiplicity of finite wires are provided, and each wire section of the wire web is assigned to one of these wires. EP 522 542 A1 has also disclosed a wire saw in which a multiplicity of endless wire loops run around the system of rollers.

During the sawing operation, the advancing device produces a relative movement of the wire sections and the workpiece, directed toward one another. As a result of this advancing movement, the wire, which is acted on by abrasive grain, for example consisting of silicon carbide, works to form parallel saw gaps through the workpiece. DE 39 42 672 A1 has disclosed both advancing devices by which the workpiece is guided onto the stationary wire web and advancing devices with which the cutting head of the wire saw is guided onto the stationary workpiece. The abrasive grain may either be contained in a sawing suspension, which is also known as a slurry, which acts on the wire, or may be securely bonded to the wire, as described, for example, in EP 0 990 498 A1.

The production of semiconductor wafers from semiconductor material in rod or block form, for example comprising single-crystal rods, imposes high demands on the wire saw. The sawing method is generally based on the object of each sawn semiconductor wafer having side faces which are as planar as possible and lie parallel and opposite to one another. What is known as the warp of the wafers is a known measure of the deviation of the actual wafer form from the desired ideal form. The warp must in general amount to at most a few $\mu$m. It is formed as a result of a relative movement of the sawing wire sections with respect to the workpiece, which over the course of the sawing process takes place in the axial direction with respect to the workpiece. This relative movement may be caused, for example, by cutting forces which occur during sawing, axial displacements of the wire-guiding rolls caused by thermal expansion, by bearing play or by the thermal expansion of the workpiece.

One of the most important causes of a relative movement between workpiece and wire sections, in the axial direction with respect to the workpiece, is that the machining of the workpiece by the abrasive grain releases a considerable amount of heat. This amount of heat released over the course of the sawing process, leads to the workpiece being heated and therefore to thermal expansion. This in turn leads not only to an increase in the warp, but also to considerable waviness of the sawn wafers. A particularly considerable increase in temperature takes place over the first few millimeters of the cut after the wire has started to cut into the workpiece. As the engagement length increases, the temperature of the workpiece rises further. The workpiece temperature reaches a maximum in the region of the maximum engagement length and then decreases again slightly. This, in addition to the decrease in machining heat, is also attributable to the cooling-fin effect of the wafers which are forming.

When using slurry as a sawing aid, the thermal expansion of the workpiece can be limited by imparting a predetermined temperature to the slurry used before it is fed to the sawing wire. This is achieved, as described in the abstract of JP 5200734, by a heat exchanger in the slurry tank. The temperature of the slurry is kept constant. The abstract of JP 7171753 describes a method in which the temperature of the slurry in the storage tank is measured. The measurement signal is used to control the flow of a cooling liquid which flows through the storage tank in a heat exchanger. This results in a constant slurry temperature. A similar method is described in the abstract of JP 10180750. In this case, the slurry flows through a heat exchanger which is fitted in the feed line leading to the wire saw. A temperature probe in the feed line between heat exchanger and wire saw makes it possible to control the flow of coolant in the heat exchanger. Thus, it is likewise possible to ensure a constant slurry temperature. The temperature-controlled slurry reduces the fluctuation in the temperature of the workpiece.

WO 00/43162 likewise discloses a number of possible ways of limiting the fluctuation in the workpiece temperature during sawing. For example, it is proposed for a cooling medium, the temperature of which is kept constant, to flow onto the workpiece during sawing. This medium is a fluid which flows through a heat exchanger before it is brought into contact with the workpiece. By way of example, slurry which is at a constant temperature is fed not only to the sawing wire but also directly to the workpiece, so that improved cooling is ensured. Other liquids or gases, such as for example air which is at a constant temperature, may also be fed to the workpiece.

The drawback of all of these prior methods is that the temperature fluctuations in the workpiece can only be compensated for to an insufficient extent.

SUMMARY OF THE INVENTION

It is an object of the present invention to provide for more efficiently avoiding the drawbacks which are associated with heating of the workpiece.

This object is achieved according to the present invention by a method for cutting up a workpiece which is in rod or block form by means of a saw, comprising measuring the temperature of the workpiece during the cutting to generate a measurement signal; transmitting the measurement signal to a control unit, which generates a control signal; and using the control signal to control the temperature of the workpiece.

The advantage of the method according to the invention is that the temperature of the workpiece is recorded while it is being cut into wafers. Therefore a targeted counter-control measure is possible in the event of temperature changes. Unlike the method according to the invention, the prior art only keeps the temperature of a cooling medium, generally the slurry, constant. Consequently, however, changes such as increases in the temperature of the workpiece can only be reduced to an insufficient extent.

It is possible, within the scope of the invention, to use any method which is suitable for influencing the temperature of the workpiece. For this purpose, it is preferable to use a fluid which is brought to the desired temperature in a heat exchanger and is then fed to the workpiece via nozzles. The nozzles are arranged above or laterally above the workpiece. Among the fluids, liquids are particularly preferred, on account of their higher heat capacity compared to gases. If the sawing aid used is a slurry, it is particularly preferred for the slurry to be used to control the temperature of the workpiece, since in this case no additional liquid container is required. The temperature of the slurry is likewise controlled in a heat exchanger. Thermoelectric cooling of the workpiece with the aid of Peltier elements, which are arranged either on the end faces of the workpiece or on the strip of cement, is also preferred. Thermoelectric cooling using Peltier elements has the particular advantage that the control variable temperature can be set rapidly on account of the low inertia.

The heat exchanger or the Peltier elements are controlled by a control unit to which the measurement signals from the measurement of the workpiece temperature are fed and which converts these signals into a control signal. The temperature of the workpiece is measured by temperature sensors, such as thermocouples or resistance thermometers. These are preferably arranged on at least one of the end faces of the workpiece. If the workpiece is cemented to a strip of cement in order to be cut up, as is customary, for example, in the fabrication of silicon wafers, temperature measurement at the strip of cement is also preferred. The temperature of the strip of cement is measured either at its surface or in bores which receive the temperature sensors.

A particularly preferred embodiment of the method according to the invention comprises first of all determining a control curve for a type of workpiece made from the same material and having the same geometry. This is preferably achieved by measuring the temperature of the workpiece during cutting and controlling it by variable cooling in the manner described above for at least one workpiece but preferably for a plurality of similar workpieces (with a mean subsequently being determined). Either the measurement signal or, alternatively, the control signal which is generated by the control unit and is used to control the cooling is recorded as a function of time. The control curve which has been determined in this way is then used to control the workpiece cooling during the cutting of further workpieces of a similar type. In this embodiment, there is no need to measure the workpiece temperature of each workpiece during cutting, since the temperature measurement is replaced by the control curve which has been determined. This method is particularly advantageous if large numbers of workpieces of a similar type are processed in the same way. If different types of workpieces are being processed, first of all the control curve needs to be determined for each type, and then the control curve which matches the material and geometry should be selected for each workpiece.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
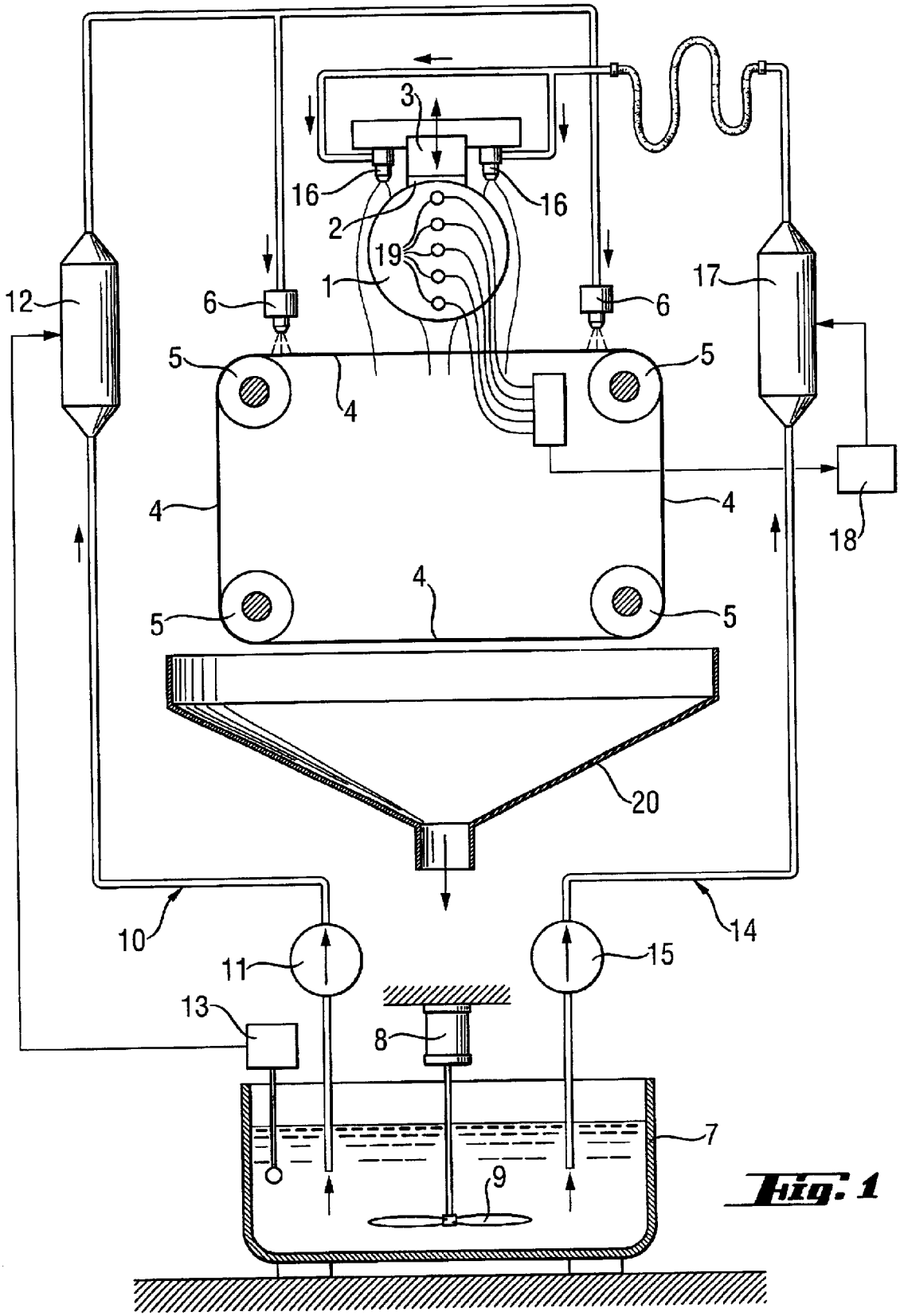
FIG. 1 diagrammatically shows a wire saw which is constructed in accordance with the invention and in which the workpiece temperature is controlled using the temperature-controlled slurry.

A preferred embodiment of the method according to the invention is described below with reference to FIG. 1.

A workpiece 1 is secured to the machine frame (not shown) of a wire saw according to the prior art by means of a strip of cement 2 and a mounting plate 3. The sawing wire 4 runs helically over four wire-guiding rollers 5 and in this way forms a wire web. Slurry acts on the sawing wire through slurry nozzles 6, the slurry being transported to the cutting location by the moving wire. (The state before the sawing process commences is illustrated in FIG. 1.) The slurry is conveyed from a vessel 7, which is equipped with a stirrer 9 driven by a motor 8, via a slurry circuit 10, with the aid of a pump 11, to the slurry nozzles 6. After it has been used in the sawing process, the slurry is returned to the vessel 7 via a collecting device 20. Between pump 11 and slurry nozzles 6, the slurry passes through a heat exchanger 12. This heat exchanger is controlled by the measurement signal from a temperature probe 13, which measures the temperature of the slurry in the vessel 7. Temperature control of this type belongs to the prior art.

In addition, the wire saw is equipped with a second slurry circuit 14. Via this circuit, slurry is conveyed from the vessel 7, through a pump 15, to the additional nozzles 16. These nozzles are arranged above or laterally above the workpiece, so that slurry is applied to the workpiece. Between pump 15 and the additional nozzles 16, the slurry passes through a heat exchanger 17. The heat exchanger is controlled by a control unit 18. According to the invention, the temperature of the workpiece is measured at at least one location during the sawing. FIG. 1 shows temperature measurement at the end side of the workpiece by five temperature sensors 19 arranged on a vertical line. The measurement signals are fed into the control unit 18, so that the heat exchanger 17 is controlled on the basis of the measured workpiece temperature. If a workpiece temperature which is higher than the desired value is measured, the slurry temperature in the heat exchanger 17 is reduced. If the workpiece temperature is below the desired value, the cooling capacity of the heat exchanger is reduced, so that a higher slurry temperature is established.

The success of the method according to the invention is demonstrated below on the basis of an Example and a Comparative Example:

COMPARATIVE EXAMPLE 1

Uncontrolled Process

Figure 2:
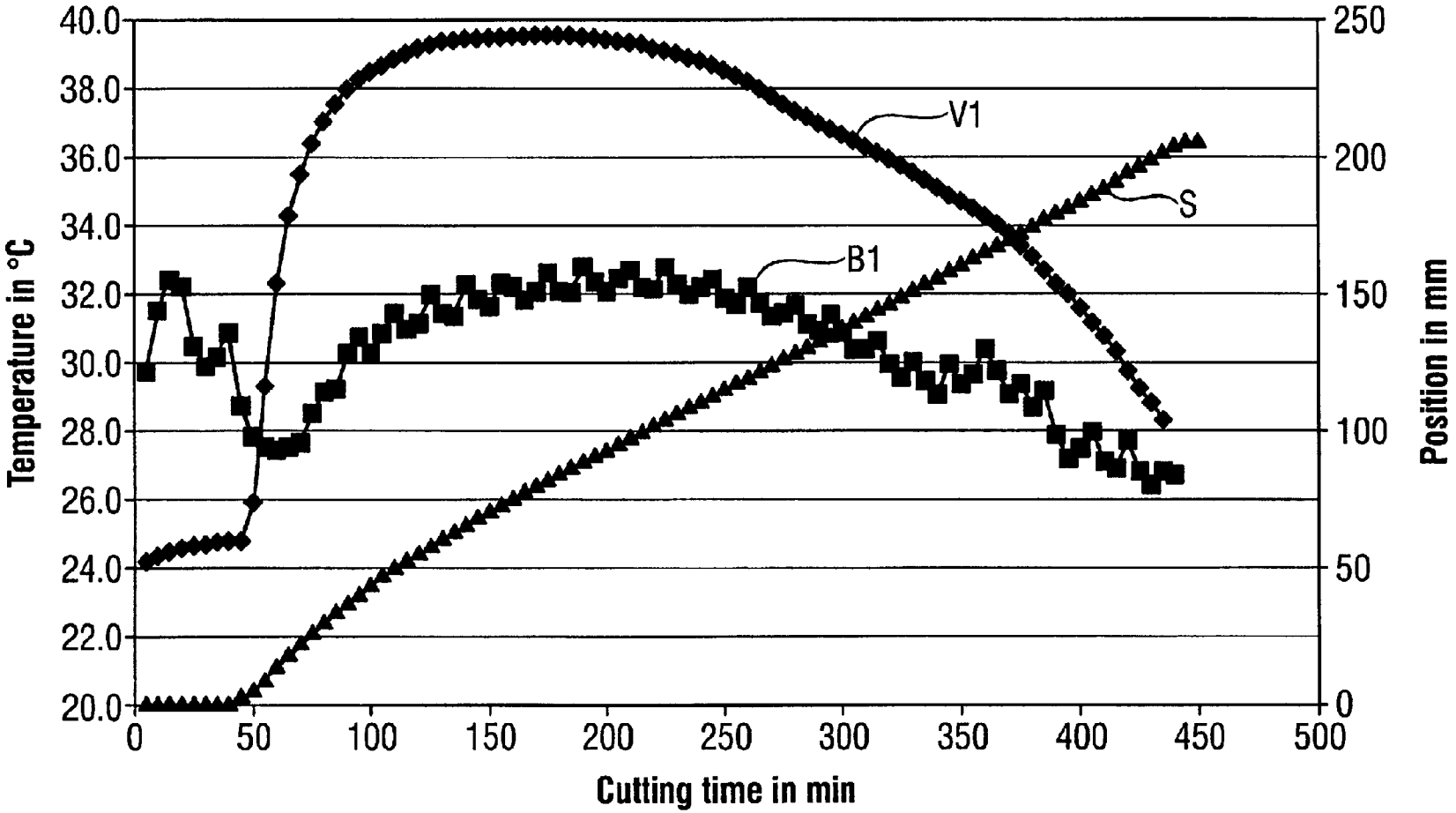
FIG. 2 shows, on the basis of the example of a silicon single crystal with a diameter of 200 mm, a comparison between the temperature profiles according to the prior art and when using temperature control in accordance with the invention.

A slurry wire saw in accordance with the prior art was used to out a silicon single-crystal rod with a diameter of 200 mm into a multiplicity of wafers. The cutting time was approximately 400 minutes. As the curve which is denoted by V1 in FIG. 2 demonstrates, the temperature of the silicon rod rises suddenly shortly after the wire has cut into the rod and reaches its maximum, which is approximately 16° C. above the temperature at the start of the process, after sawing has been under way for somewhat more than 100 minutes. The temperature then drops slowly by about 12° C. by the end of the process. The curve denoted by S indicates the position of the cutting head in mm and therefore the progress of sawing.

EXAMPLE 1

Controlled Process

All the parameters of the method were selected to be the same as in Comparative Example 1. In addition, however, temperature control according to the invention was used instead of a constant slurry temperature, so that cooling liquid which was at a variable temperature flowed over the workpiece via the nozzles 16 in such a manner that the change in temperature of the workpiece remained as low as possible. In this case, the fluctuation in the workpiece temperature is only about 5° C., as shown by the curve denoted by B1 in FIG. 2. As a result, the maximum warp of the sawn wafers can be reduced from typically 15 $\mu$m to 10 $\mu$m.

The application area of the invention extends to all sawing methods in which a high degree of planarity and low waviness of the products are important. Since the invention does not use any saw-specific features, it can be used for any desired saws, in particular for wire saws which operate with bonded abrasive grain (diamond wire) or slurry, but also for bandsaws and annular saws.

Accordingly, while only a few embodiments of the present invention have been shown and described, it is obvious that many changes and modifications may be made thereunto without departing from the spirit and scope of the invention.

What is claimed is:

1. A method for cutting up a workpiece which is in a form selected from the group consisting of a rod and a block by means of a saw, comprising determining a control curve by measuring temperature of the workpiece during cutting, and using a temperature measurement to generate a measurement signal;

using the measurement signal to control the temperature of the workpiece; and recording the control curve;

providing a predetermined control curve; and selecting a control curve to match material and geometry of the workpiece; and controlling temperature of the workpiece during the cutting by a control signal based on said predetermined control curve.

2. A method for cutting up a workpiece which is in a form selected from the group consisting of a rod and a block by means of a saw, comprising measuring temperature of the workpiece during the cutting, to generate a measurement signal;

transmitting the measurement signal to a control unit, which generates a control signal; and using the control signal to control the temperature of the workpiece;

wherein the control signal controls a heat exchanger which sets temperature of a cooling medium; and feeding the cooling medium to the workpiece so as to control the temperature of the workpiece; such that if a workpiece temperature which is higher than a desired value is measured, the cooling medium temperature in the heat exchanger is reduced, and if the workpiece temperature is below the desired value, the cooling capacity of the heat exchanger is reduced so that a higher temperature of the cooling medium is established.

3. The method as claimed in claim 2, wherein the cooling medium is selected from the group consisting of a liquid and a gas; and feeding the cooling medium to the workpiece via nozzles which are arranged in a manner selected from the group consisting of above the workpiece and laterally above the workpiece.

4. The method as claimed in claim 3, wherein the liquid is identical to a slurry used for cutting up the workpiece.

5. The method as claimed in claim 2, wherein the control signal controls at least one Peltier element which is arranged in a manner selected from the group consisting of on the workpiece and on a strip of cement on the workpiece and is used to control the temperature of the workpiece.

6. The method as claimed in claim 2, wherein the temperature of the workpiece is simultaneously measured at a plurality of locations selected from the group consisting of on a surface of the workpiece, on a strip of cement on the workpiece, and in bores in the strip of cement on the workpiece.

7. The method as claimed in claim 2, wherein the temperature of the workpiece is measured at the end side of the workpiece.

8. The method as claimed in claim 2, wherein the temperature of the workpiece is kept constant.

* * * * *